US011380504B2

(12) United States Patent
Miyake et al.

(10) Patent No.: US 11,380,504 B2
(45) Date of Patent: Jul. 5, 2022

(54) RELAY WITH CARD MADE FROM RESIN

(71) Applicant: OMRON Corporation, Kyoto (JP)

(72) Inventors: Ayaka Miyake, Kikuchi (JP); Tatsuro Kitagawa, Koshi (JP); Tamako Oyama, Kumamoto (JP); Takuya Kondo, Fukuoka (JP)

(73) Assignee: OMRON CORPORATION, Kyoto (JP)

( * ) Notice: Subject to any disclaimer, the term of this patent is extended or adjusted under 35 U.S.C. 154(b) by 0 days.

(21) Appl. No.: 16/979,868

(22) PCT Filed: Feb. 18, 2019

(86) PCT No.: PCT/JP2019/005932
§ 371 (c)(1),
(2) Date: Sep. 11, 2020

(87) PCT Pub. No.: WO2019/187781
PCT Pub. Date: Oct. 3, 2019

(65) Prior Publication Data

US 2021/0012993 A1 Jan. 14, 2021

(30) Foreign Application Priority Data

Mar. 27, 2018 (JP) ..... JP2018-060045

(51) Int. Cl.
*H01H 50/64* (2006.01)
*H01H 50/24* (2006.01)
*H01H 50/54* (2006.01)

(52) U.S. Cl.
CPC ..... *H01H 50/642* (2013.01); *H01H 50/24* (2013.01); *H01H 50/54* (2013.01)

(58) Field of Classification Search
CPC ..... H01H 50/24; H01H 50/54; H01H 50/642; H01H 50/26; H01H 50/64
See application file for complete search history.

(56) References Cited

U.S. PATENT DOCUMENTS 7,859,371 B2 * 12/2010 Takano ..... H01H 50/30 335/78
7,876,184 B2 * 1/2011 Mikl ..... H01H 50/642 335/126

(Continued)

FOREIGN PATENT DOCUMENTS

CN 1224915 A 8/1999
CN 1499556 A 5/2004

(Continued)

OTHER PUBLICATIONS

The International Search Report of International Application No. PCT/JP2019/005932 dated Apr. 16, 2019.

(Continued)

*Primary Examiner* — Bernard Rojas
(74) *Attorney, Agent, or Firm* — Shinjyu Global IP

(57) ABSTRACT

A relay includes a fixed terminal, a fixed contact connected to the fixed terminal, a movable contact piece facing the fixed terminal, a movable contact, a card, and a drive unit configured to generate a driving force to operate the card. The movable contact is connected to the movable contact piece and faces the fixed contact. The card is made from resin and presses the movable contact piece to operate the movable contact piece. The card includes a first pressing portion and a second pressing portion. The first and second pressing portions are configured to contact the movable contact piece and press the movable contact piece. The second pressing portion is disposed apart from the first pressing portion in a width direction of the movable contact piece. The first and second pressing portions are disposed inside side edges of the movable contact piece in the width direction respectively.

14 Claims, 15 Drawing Sheets

(56) References Cited

U.S. PATENT DOCUMENTS

| | | | | |
|---|---|---|---|---|
| 8,102,227 | B2 * | 1/2012 | Fujiwara | H01H 50/643 335/78 |
| 8,193,881 | B2 * | 6/2012 | Yuba | H01H 9/443 335/78 |
| 8,816,800 | B2 * | 8/2014 | Mikl | H01H 50/64 335/83 |
| 2004/0130419 | A1 | 7/2004 | Sanada et al. | |
| 2004/0263293 | A1 * | 12/2004 | Saruwatari | H01H 50/642 335/128 |
| 2015/0123750 | A1 * | 5/2015 | Pan | H01H 49/00 335/2 |
| 2017/0323748 | A1 * | 11/2017 | Gutmann | H01H 50/02 |

FOREIGN PATENT DOCUMENTS

| | | | |
|---|---|---|---|
| CN | 101271801 | A | 9/2008 |
| CN | 102568937 | A | 7/2012 |
| CN | 102969205 | A | 3/2013 |
| CN | 104377084 | A | 2/2015 |
| CN | 106298370 | A | 1/2017 |
| CN | 205984825 | U | 2/2017 |
| JP | 55-30161 | A | 3/1980 |
| JP | 3-46946 | U | 4/1991 |
| JP | 8-329814 | A | 12/1996 |
| JP | 10-3840 | A | 1/1998 |
| JP | 11-213839 | A | 8/1999 |
| JP | 2004-158382 | A | 6/2004 |
| JP | 2012-160325 | A | 8/2012 |

OTHER PUBLICATIONS

The Written Opinion of the International Searching Authority of International Application No. PCT/JP2019/005932 dated Apr. 16, 2019.

Supplementary European search report of the corresponding European Application No. 19775938.4 dated Nov. 30, 2021.

The Office Action for the corresponding Chinese application No. 201980015983.7, dated Dec. 27, 2021.

* cited by examiner (A)

(B)

RELAY WITH CARD MADE FROM RESIN

CROSS-REFERENCE TO RELATED APPLICATION

This application is the U.S. National Phase of International Application No. PCT/JP2019/005932, filed on Feb. 18, 2019. This application claims priority to Japanese Patent Application No. 2018-060045, filed Mar. 27, 2018. The contents of those applications are incorporated by reference herein in their entireties.

FIELD

The present invention relates to a relay.

BACKGROUND

There is known a relay that opens and closes a contact by operating a card with a drive unit and pressing a movable contact piece with the card. For example, Japanese Patent Application Publication No. 2012-160325A discloses a relay in which the card is disposed between an armature and the movable contact piece. When the armature is operated by electromagnetic force generated from a coil, the operation of the armature is transmitted to the movable contact piece via the card.

SUMMARY

When the card is made from resin, resin shavings are generated due to abrasion of the card by contact with the movable contact piece. When the resin shavings reach the contact by coming around behind the movable contact piece, there is a possibility that the contact may have a contact failure.

An object of the present invention is to provide a relay with a card made from resin that can suppress an occurrence of contact failure due to resin shavings.

The relay according to one aspect comprises a fixed terminal, a fixed contact, a movable contact piece, a movable contact, a card, and a drive unit. The fixed contact is connected to the fixed terminal. The movable contact piece is disposed to face the fixed terminal. The movable contact is connected to the movable contact piece and is disposed to face the fixed contact. The card is made from resin and presses the movable contact piece to operate the movable contact piece. The drive unit generates a driving force for operating the card.

The card includes a first pressing portion and a second pressing portion. The first pressing portion and the second pressing portion are configured to contact the movable contact piece and press the movable contact piece. The second pressing portion is disposed apart from the first pressing portion in a width direction of the movable contact piece. The first pressing portion and the second pressing portion are disposed inside side edges of the movable contact piece in the width direction respectively.

In the relay according to this aspect, the first pressing portion and the second pressing portion are disposed inside the side edges of the movable contact piece in the width direction respectively. Resin shavings generated by the first pressing portion and the second pressing portion contacting with the movable contact piece can easily pass through the sides of the movable contact piece to reach the contact side. Since the first pressing portion and the second pressing portion are arranged as described above, it becomes difficult for resin shavings to reach the contact side through the sides of the movable contact piece. As a result, it is possible to suppress an occurrence of contact failure due to resin shavings.

The drive unit may include a coil and an armature. The armature may be operated by electromagnetic force generated from the coil to operate the card. The card may further include a central contact portion disposed at a center of the card in the width direction. The central contact portion may have a shape that is convexly curved toward the armature and may be pressed against the armature. In this case, the card comes into contact with the armature at one point in the central contact portion, whereas it comes into contact with the movable contact piece at two points of the first pressing portion and the second pressing portion. This can improve stability of operation.

The central contact portion may contact the armature at a location between the first pressing portion and the second pressing portion in the width direction. In this case, the stability of operation can be further improved.

A tip of the first pressing portion may have a shape that is convexly curved toward the movable contact piece. A tip of the second pressing portion may have a shape that is convexly curved toward the movable contact piece. In this case, the movable contact piece can be stably pressed by the tip of the first pressing portion and the tip of the second pressing portion.

The card may include a card body and the contact part. The card body may be disposed between the drive unit and the movable contact piece. The contact part may extend from the card body toward the movable contact piece. The first pressing portion and the second pressing portion may be disposed at the tip of the contact part. The card body may have a larger width than a width between an outer lateral end of the first pressing portion and an outer lateral end of the second pressing portion. In this case, since the card body is large in the width direction, an insulation distance between the movable contact piece and the drive unit can be increased.

The first pressing portion and the second pressing portion may contact a surface of the movable contact piece to press the movable contact piece. In this case, the first pressing portion and the second pressing portion come into contact with the surface of the movable contact piece to cause abrasion. This allows the effect of suppressing the occurrence of poor contact due to resin shavings to become more significant.

The card may include a first connecting portion and a second connecting portion. The first connecting portion and the second connecting portion may protrude toward the movable contact piece and may be connected to the movable contact piece. The first connecting portion and the second connecting portion may be disposed outside the first pressing portion and the second pressing portion in the width direction. In this case, the first connecting portion and the second connecting portion can suppress wobbling of the card in the width direction with respect to the movable contact piece. As a result, the movable contact piece can be stably pressed by the first pressing portion and the second pressing portion.

The card may further include a first recess and a second recess. The first recess may be disposed between the first pressing portion and the first connecting portion. The second recess may be disposed between the second pressing portion and the second connecting portion. In this case, resin shavings generated from the first pressing portion can be released through the first recess. Similarly, resin shavings generated from the second pressing portion can be released through the second recess. Therefore, it is possible to prevent resin shavings from reaching the contact side through the sides of the movable contact piece. As a result, it is possible to suppress the occurrence of contact failure due to resin shavings.

The card may further include a recess located between the first pressing portion and the second pressing portion. In this case, it is possible to prevent a portion of the card between the first pressing portion and the second pressing portion from contacting the movable contact piece. As a result, it is possible to prevent the card from coming into contact with the central portion of the movable contact piece in the width direction where the temperature becomes high. Accordingly, the relay can suppress wear of the card due to heat from the movable contact piece.

According to the present invention, the relay including a card made from resin can suppress an occurrence of contact failure due to resin shavings.

DETAILED DESCRIPTION

Figure 1:
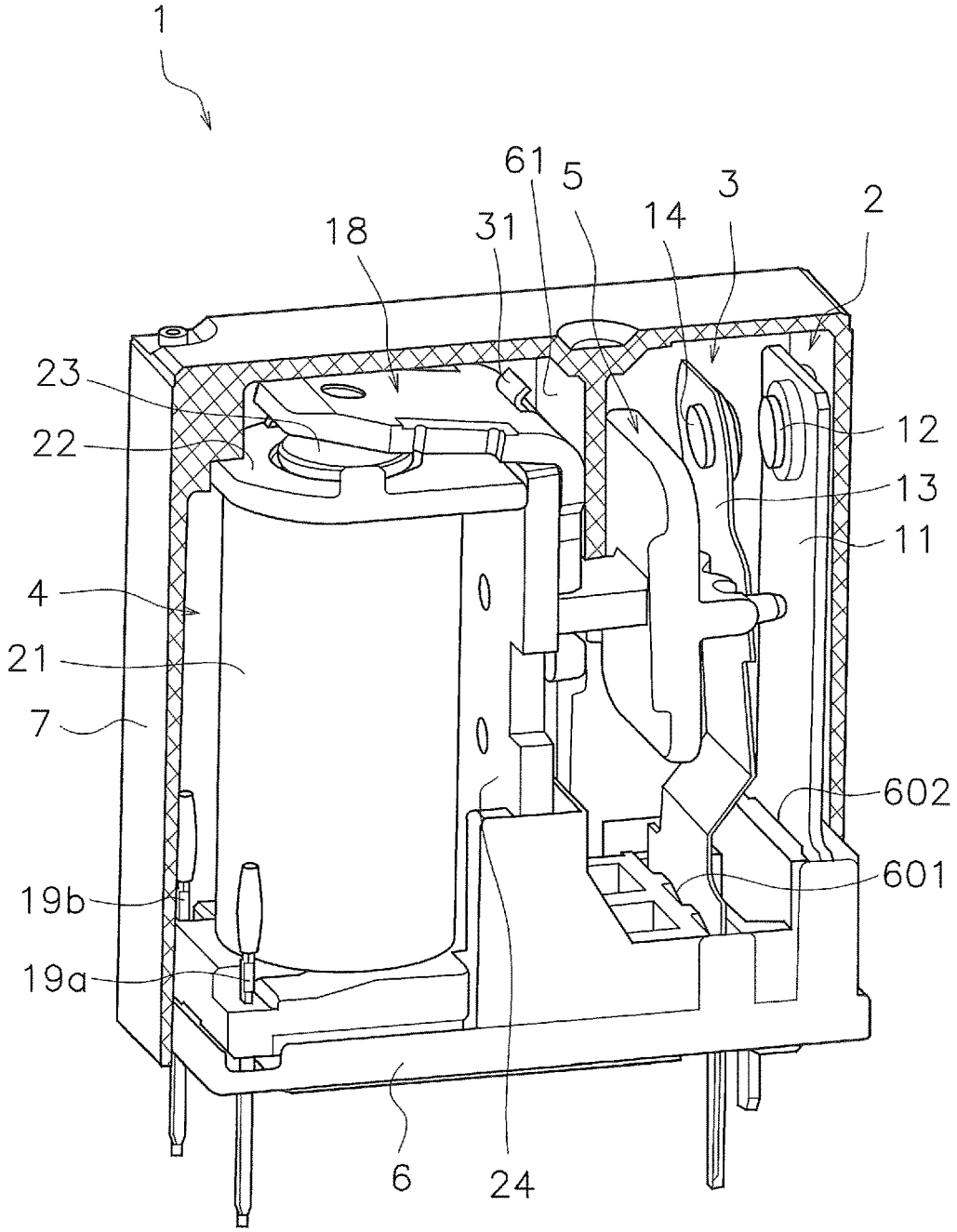
FIG. 1 is a perspective view of a relay according to an embodiment.
Figure 2:
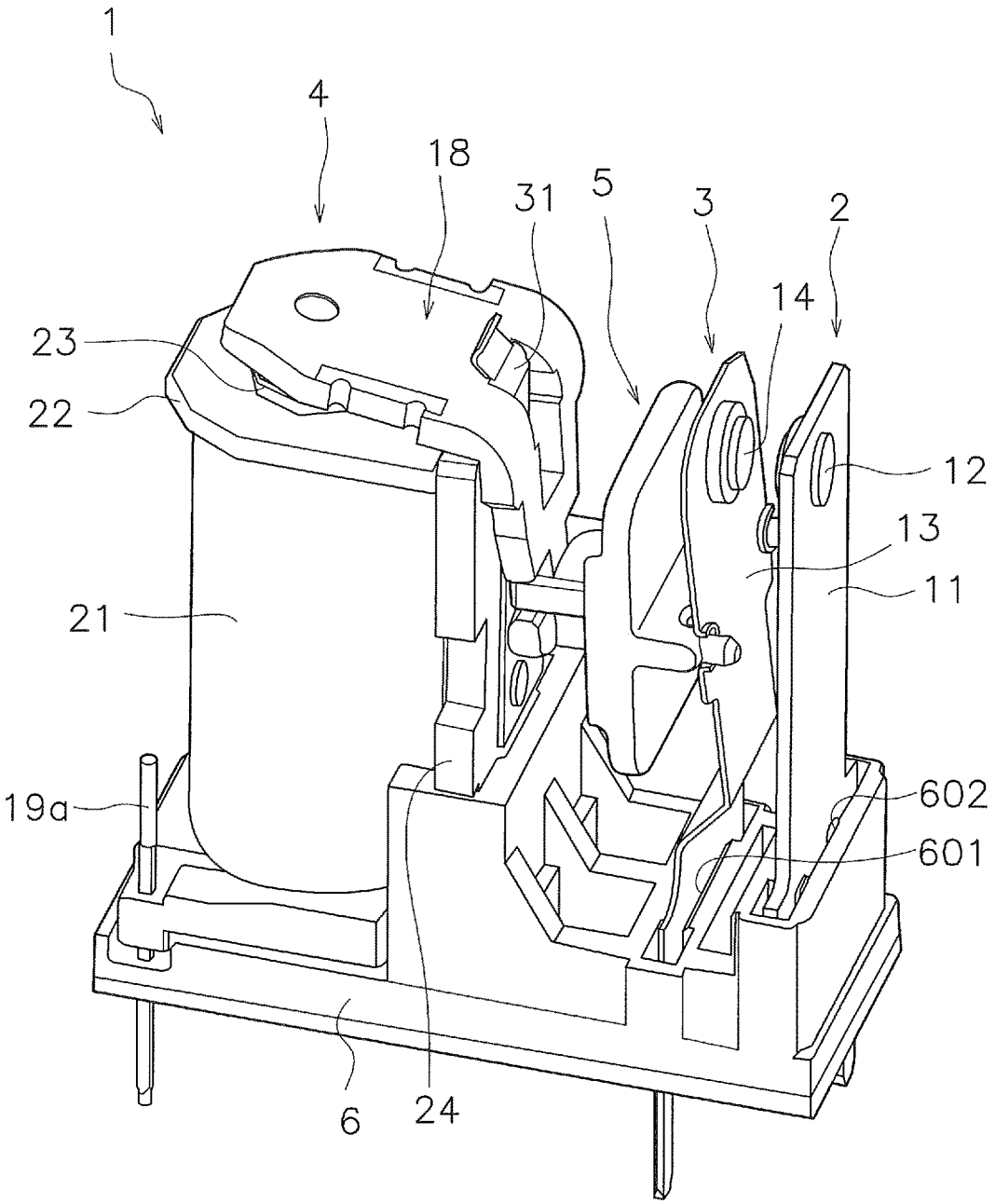
FIG. 2 is a perspective view of the relay.
Figure 3:
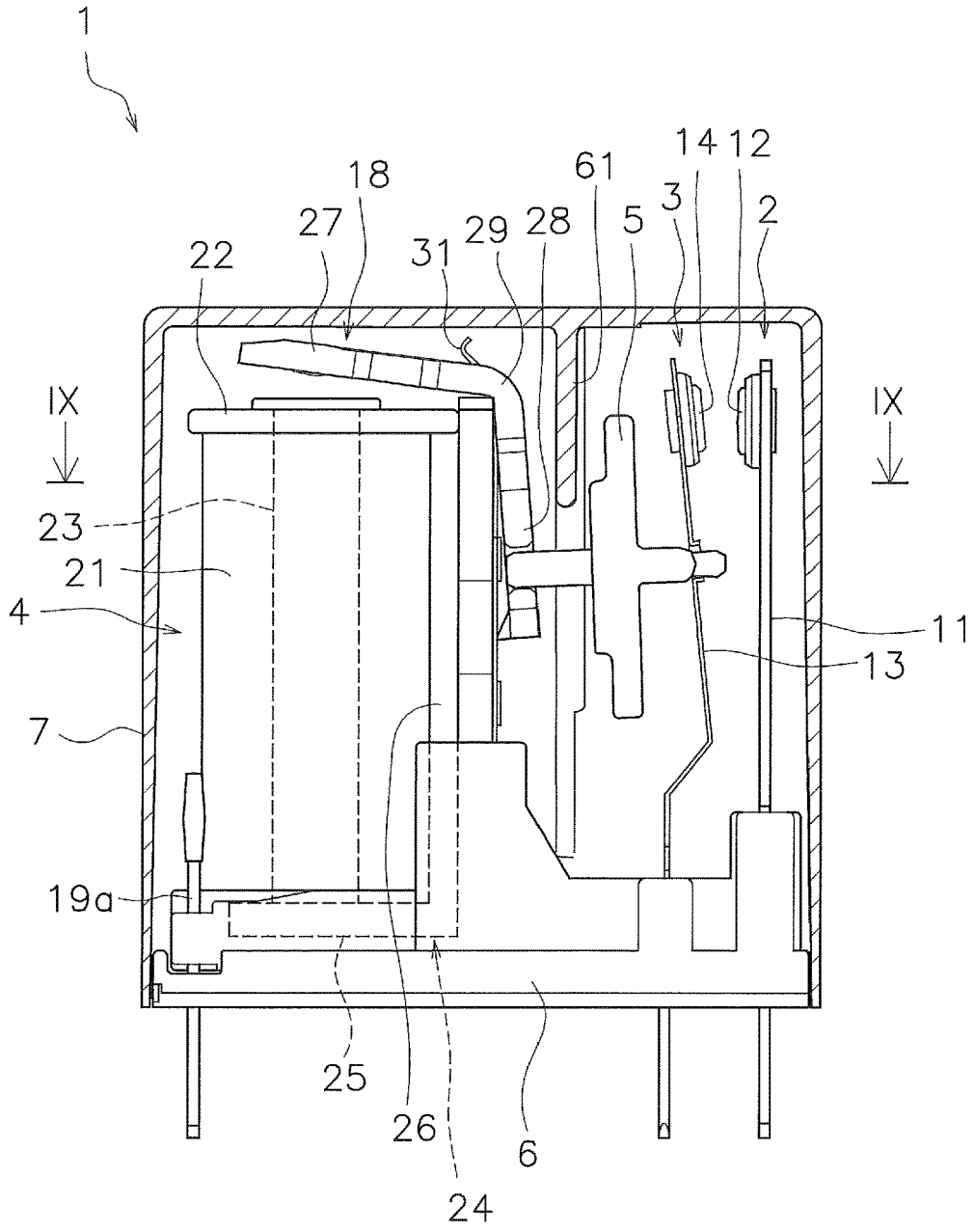
FIG. 3 is a front view of the relay.

Hereinafter, an example of the relay according to the embodiment will be described with reference to the drawings. FIGS. 1 and 2 are perspective views showing a relay 1 according to the embodiment. FIG. 3 is a front view of the relay 1. As illustrated in FIGS. 1 to 3, the relay 1 includes a fixed contact unit 2, a movable contact unit 3, a drive unit 4, a card 5, a base 6, and a case 7. In FIGS. 1 and 3, the case 7 is illustrated in cross section. In FIG. 2, the case 7 is not shown.

The fixed contact unit 2 includes a fixed terminal 11 and a fixed contact 12. The fixed terminal 11 and the fixed contact 12 are made of a conductive material. The fixed contact 12 is attached to the fixed terminal 11. The fixed terminal 11 is supported by the base 6. One end of the fixed terminal 11 projects from the base 6 to the outside of the relay 1. The other end of the fixed terminal 11 is located inside the case 7, where the fixed contact 12 is attached.

The movable contact unit 3 includes a movable contact piece 13 and a movable contact 14. The movable contact piece 13 and the movable contact 14 are made of a conductive material. The movable contact piece 13 is supported by the base 6. One end of the movable contact piece 13 projects from the base 6 to the outside of the relay 1. The other end of the movable contact piece 13 is located inside the case 7, where the movable contact 14 is attached. The movable contact piece 13 is made of an elastic material. The movable contact piece 13 is disposed between the fixed terminal 11 and the drive unit 4. The movable contact piece 13 is disposed to face the fixed terminal 11. The movable contact 14 is disposed to face the fixed contact 12.

In the following description, the direction in which the movable contact piece 13 extends from the base 6 is referred to as "upward" and its opposite direction is referred to as "downward" in the case 7. Further, the width direction means a direction orthogonal to a plate thickness direction and an up-down direction of the movable contact piece 13, which is a direction perpendicular to the paper surface of FIG. 3. However, the definitions of these directions are used for convenience of description, and do not limit the orientation of the relay 1 and such other orientations.

The drive unit 4 generates a driving force for operating the card 5. The drive unit 4 is supported by the base 6. The drive unit 4 includes a coil 21, a bobbin 22, an iron core 23, a yoke 24, and an armature 18. The coil 21 is wound around the bobbin 22. The axis of the coil 21 extends in the up-down direction. The coil 21 is connected to the coil terminals 19*a* and 19*b*. The coil terminals 19*a* and 19*b* are supported by the bobbin 22. The iron core 23 is inserted in the bobbin 22.

As illustrated in FIG. 3, the yoke 24 has an L-shaped bent. The yoke 24 is connected to the iron core 23. Specifically, the yoke 24 has a yoke bottom 25 and a yoke side 26. The yoke bottom 25 is disposed below the coil 21. The lower end portion of the iron core 23 projects downward from the bobbin 22, and the yoke bottom 25 is connected to the lower end portion of the iron core 23. The yoke side 26 is disposed on a side of the coil 21. The yoke side 26 extends in the up-down direction.

The armature 18 is rotatably supported on the upper end of the yoke 24. The armature 18 operates by electromagnetic force generated from the coil 21. Specifically, the armature 18 is rotatably supported on the upper end of the yoke side 26. The armature 18 has an L-shaped bent. As illustrated in FIG. 3, the armature 18 includes a first portion 27, a second portion 28, and a third portion 29. The first portion 27 is disposed above the iron core 23. The first portion 27 is disposed to face the iron core 23. The second portion 28 is disposed to face the card 5. The third portion 29 is disposed between the first portion 27 and the second portion 28. The armature 18 has a bent shape at the third portion 29.

A hinge spring 31 is attached to the armature 18 and the yoke 24. The hinge spring 31 is made of an elastic material. The hinge spring 31 biases the armature 18 in a direction in which the first portion 27 contacts the iron core 23.

The base 6 is made of an insulating material. The base 6 is made from resin. However, the base 6 may be formed of a material other than resin. The base 6 supports the fixed contact unit 2, the movable contact unit 3, and the drive unit 4.

As illustrated in FIG. 1, the case 7 is put on the base 6. The case 7 is made of an insulating material. The case 7 is made from resin. However, the case 7 may be formed of a material other than resin. As illustrated in FIG. 1, the case 7 has a wall 61. The wall 61 is disposed between the armature 18 and the card 5. The wall 61 is formed integrally with the case 7. However, the wall 61 may be separate from the case 7.

Figure 4:
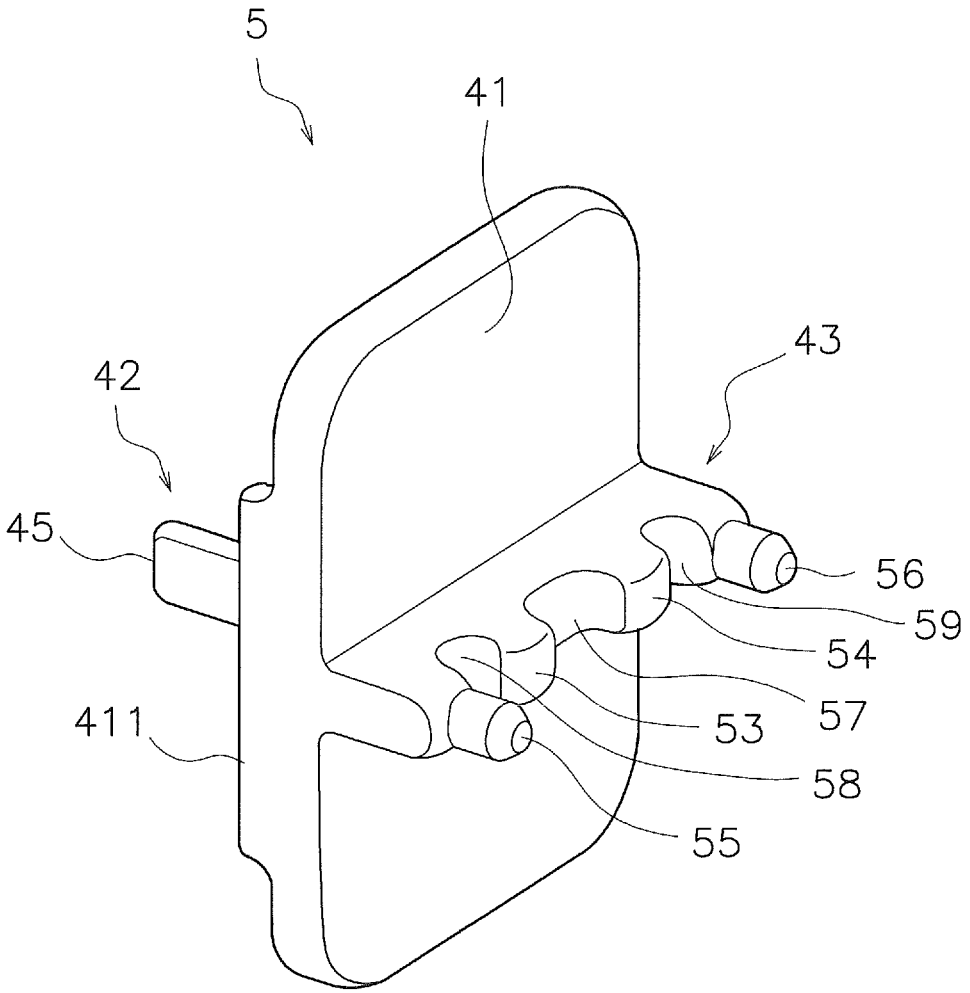
FIG. 4 is a perspective view of a card.
Figure 5:
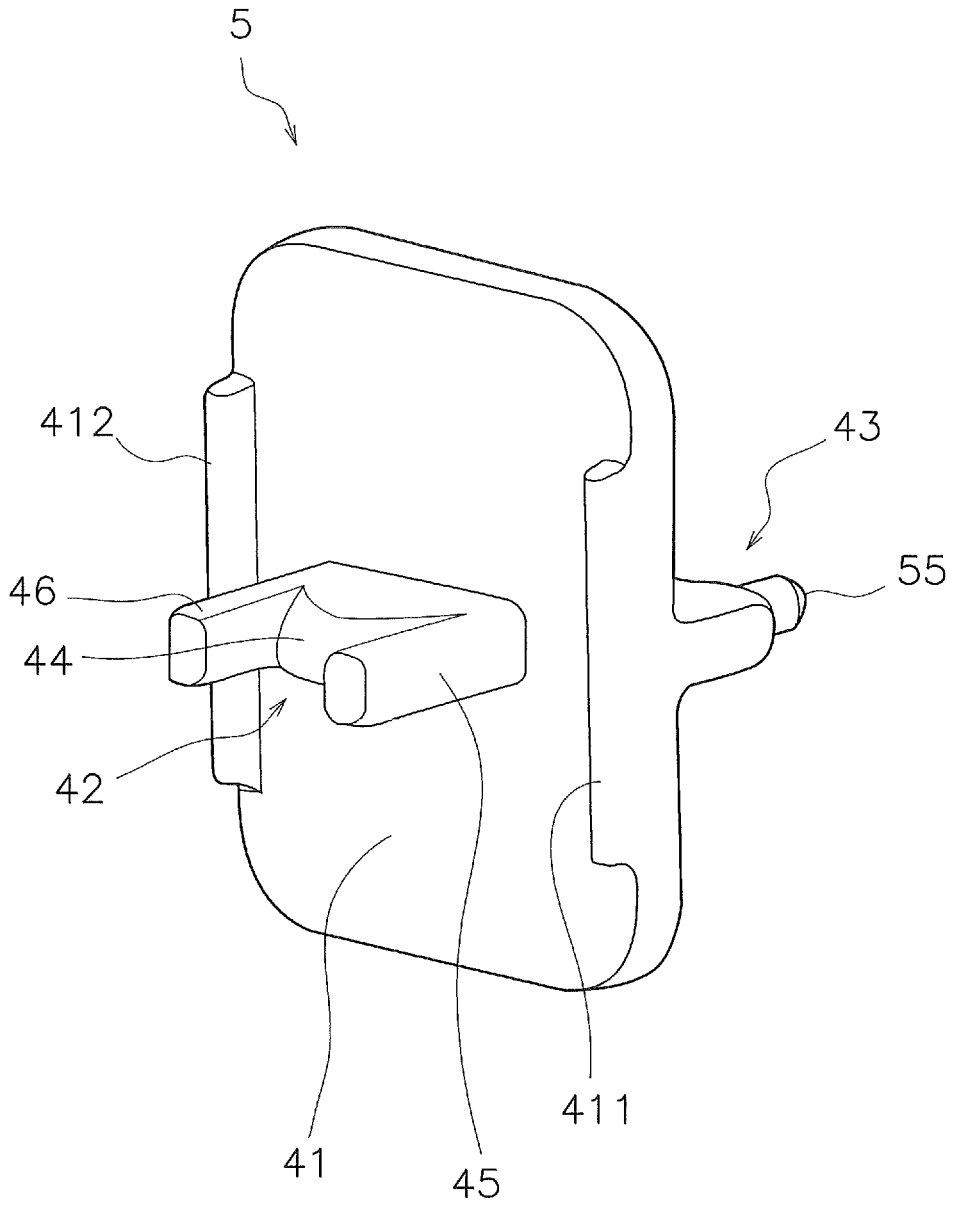
FIG. 5 is a perspective view of the card.
Figure 6:
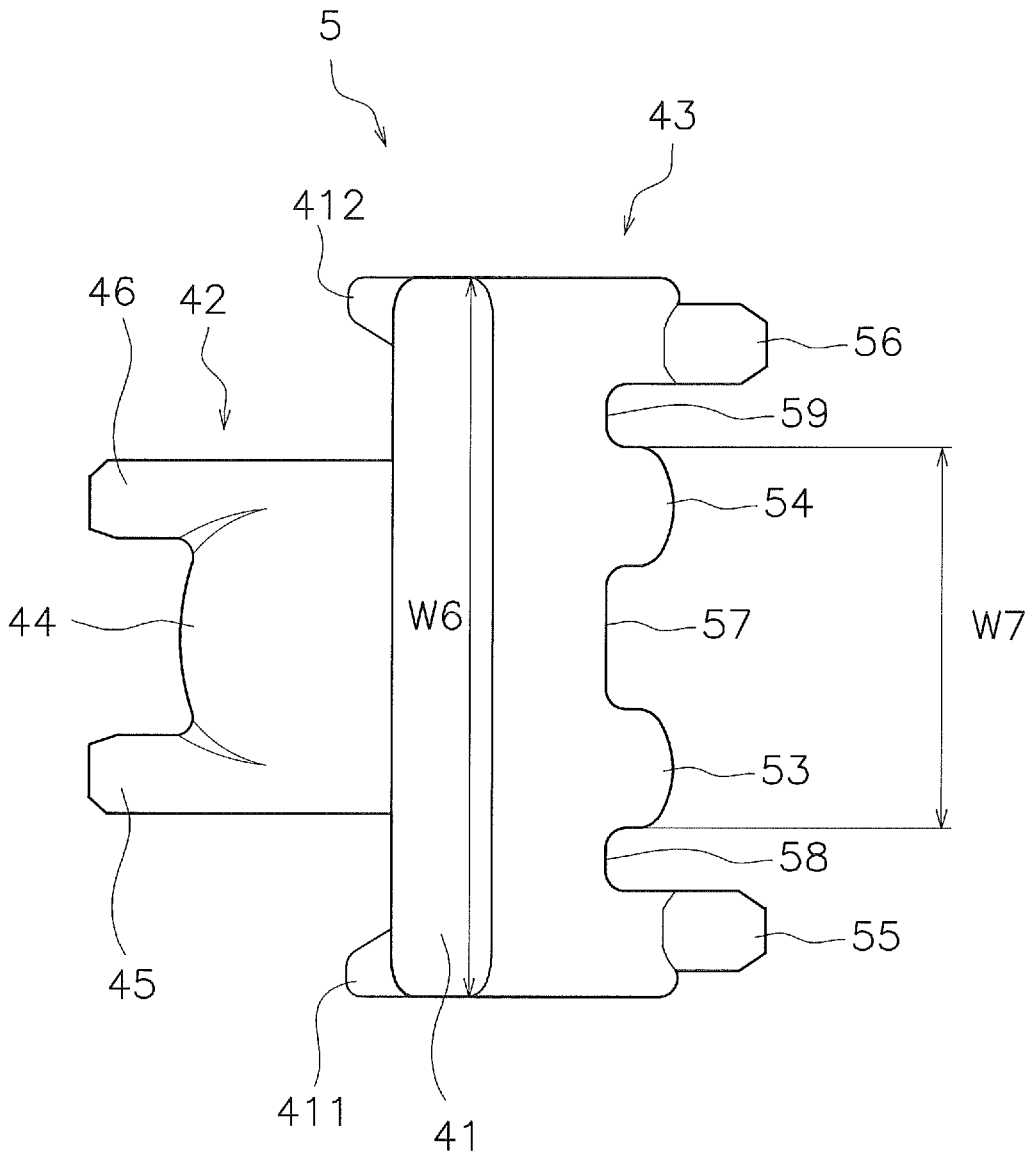
FIG. 6 is a top view of the card.

The card 5 is disposed between the drive unit 4 and the movable contact piece 13. The card 5 transmits the operation of the armature 18 to the movable contact piece 13. The card 5 is made from resin. FIGS. 4 and 5 are perspective views of the card 5. FIG. 6 is a top view of the card 5. As illustrated in FIGS. 4 to 6, the card 5 includes a card body 41, a first contact part 42, and a second contact part 43.

The card body 41 has a plate-like shape extending in the up-down direction. The card body 41 includes a first card protrusion 411 and a second card protrusion 412. The first card protrusion 411 and the second card protrusion 412 protrude from the card body 41 toward the drive unit 4. The first card protrusion 411 and the second card protrusion 412 extend in the up-down direction. The first card protrusion 411 and the second card protrusion 412 are disposed along and on both side edges of the card body 41 respectively.

Figure 7:
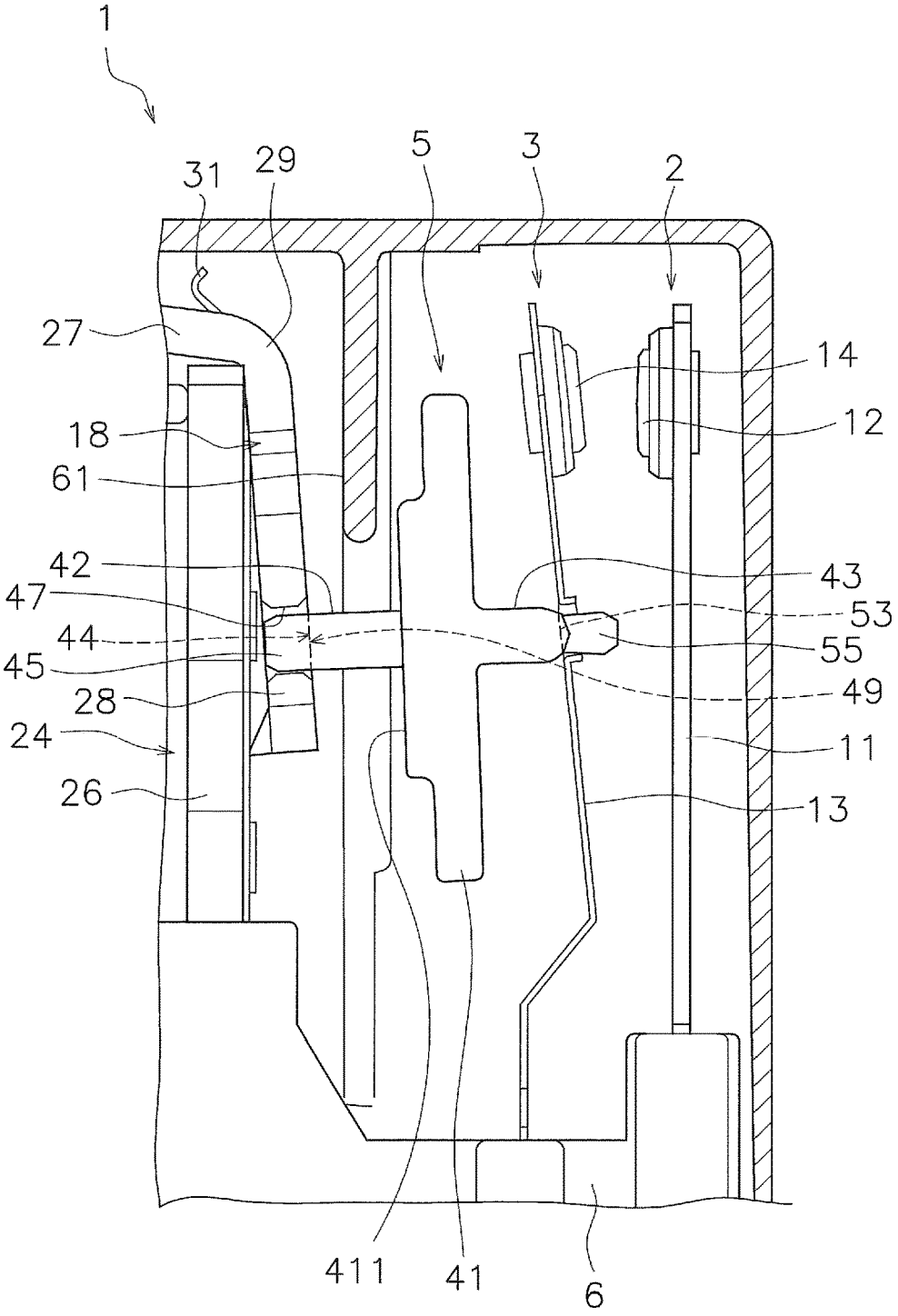
FIG. 7 is an enlarged front view of the relay.

FIG. 7 is an enlarged front view of the relay showing a structure around the card. As illustrated in FIG. 7, the card body 41 is disposed between the movable contact piece 13 and the second portion 28 of the armature 18. The first contact part 42 extends from the card body 41 toward the armature 18. The first contact part 42 is disposed to face the second portion 28 of the armature 18. The first contact part 42 is connected to the second portion 28 of the armature 18. The second contact part 43 is disposed to face the movable contact piece 13. The second contact part 43 is connected to the movable contact piece 13.

As illustrated in FIG. 6, the first contact part 42 includes a central contact portion 44, a first extending portion 45, and a second extending portion 46. The first extending portion 45 is disposed on one side of the central contact portion 44 and extends toward the drive unit 4 further than the central contact portion 44 does. The second extending portion 46 is disposed on the other side of the central contact portion 44 and extends toward the drive unit 4 further than the central contact portion 44 does. The central contact portion 44 has a shape that is convexly curved toward the armature 18.

Figure 8:
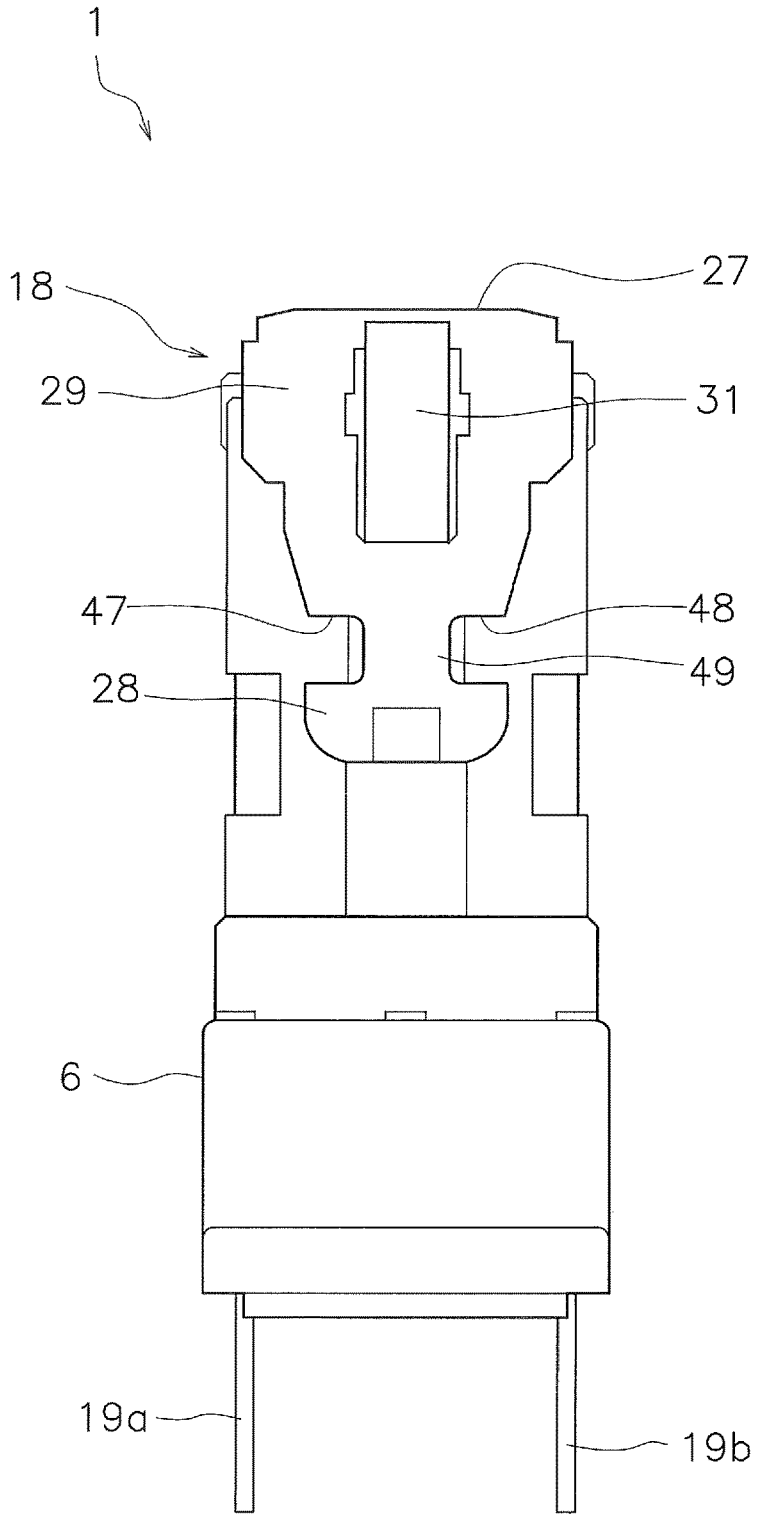
FIG. 8 is a side view of the relay showing an armature.

FIG. 8 is a side view of the relay 1. In FIG. 8, the case 7, the fixed contact unit 2, the movable contact unit 3, and the card 5 are not shown. The second portion 28 of the armature 18 includes a first recess 47, a second recess 48 and a pressing portion 49. The pressing portion 49 is disposed between the first recess 47 and the second recess 48. As illustrated in FIG. 7, the first extending portion 45 of the card 5 is disposed in the first recess 47. Similarly, the second extending portion 46 of the card 5 is disposed in the second recess 48.

The pressing portion 49 is disposed between the first extending portion 45 and the second extending portion 46. The pressing portion 49 is disposed to face the central contact portion 44 of the first contact part 42. When the armature 18 rotates so that the first portion 27 comes closer to the iron core 23, the pressing portion 49 contacts and presses the central contact portion 44 of the first contact part 42. This causes the operation of the armature 18 to be transmitted to the card 5.

As illustrated in FIGS. 4 to 6, the second contact part 43 includes a first pressing portion 53, a second pressing portion 54, and a recess 57. The first pressing portion 53 and the second pressing portion 54 protrude from a tip of the second contact part 43 toward the movable contact piece 13. The first pressing portion 53 and the second pressing portion 54 are disposed to face the movable contact piece 13. The first pressing portion 53 and the second pressing portion 54 contact the movable contact piece 13 to press the movable contact piece 13.

The first pressing portion 53 and the second pressing portion 54 are disposed apart from each other in the width direction of the movable contact piece 13. The first pressing portion 53 and the second pressing portion 54 are disposed inside the side edges of the movable contact piece 13 in the width direction. As illustrated in FIG. 6, the width W6 of the card body 41 is larger than the width W7 between the outer lateral end of the first pressing portion 53 and the outer lateral end of the second pressing portion 54. A tip of the first pressing portion 53 has a shape that is convexly curved toward the movable contact piece 13. A tip of the second pressing portion 54 has a shape that is convexly curved toward the movable contact piece 13.

Figure 9:
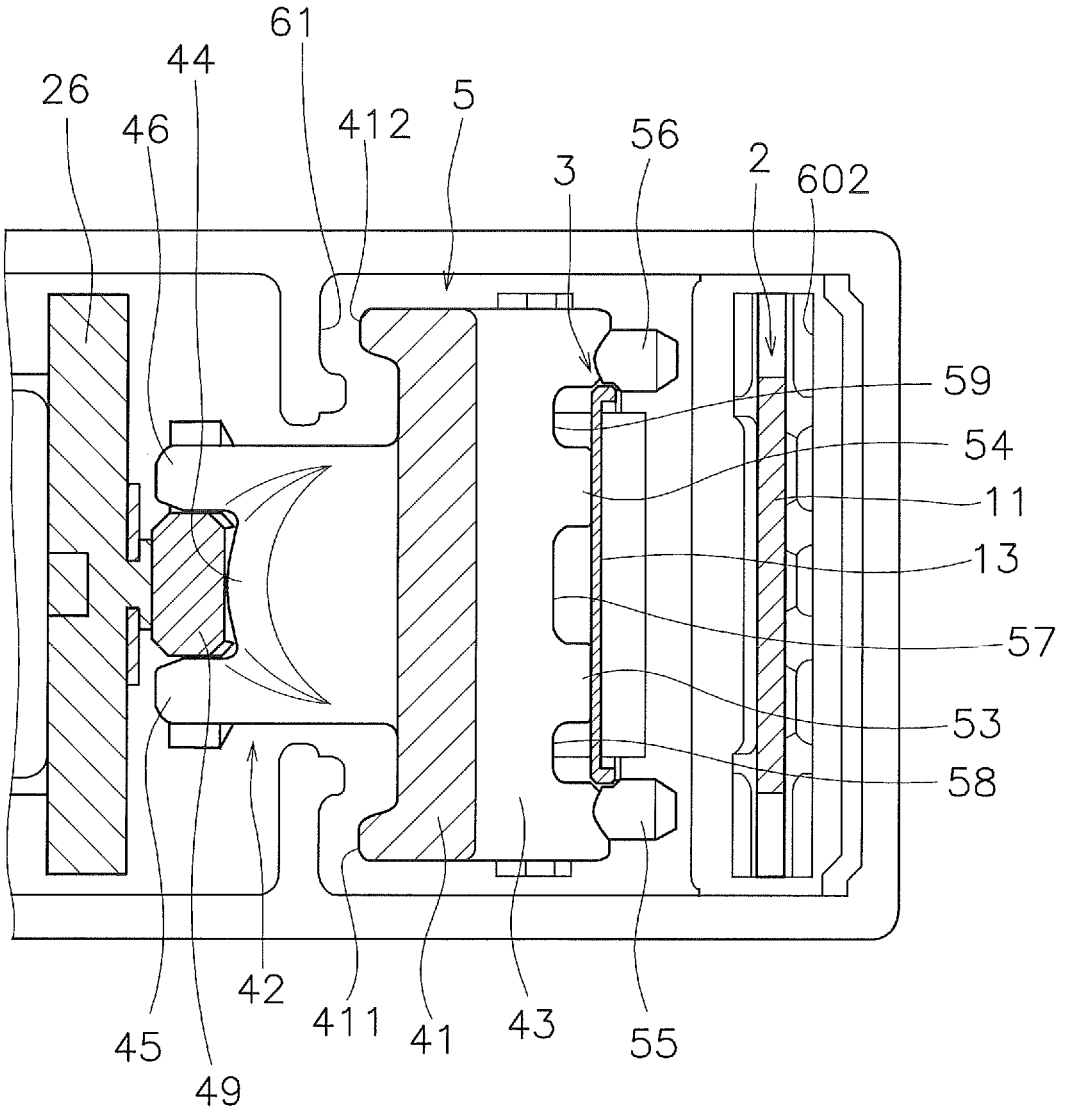
FIG. 9 shows a part of a cross-sectional view of FIG. 3 taken along line IX-IX.

FIG. 9 is a cross-sectional view taken along the line IX-IX in FIG. 3. As illustrated in FIG. 9, the tip of the first pressing portion 53 and the tip of the second pressing portion 54 are disposed to face the movable contact piece 13. The first pressing portion 53 and the second pressing portion 54 are not fixed with respect to the movable contact piece 13. The tip of the first pressing portion 53 and the tip of the second pressing portion 54 contact a surface of the movable contact piece 13 to press the movable contact piece 13.

The recess 57 is disposed between the first pressing portion 53 and the second pressing portion 54. The recess 57 faces a central portion of the movable contact piece 13 in the width direction. The recess 57 has a shape recessed in a direction away from the movable contact piece 13. The recess 57 is disposed apart from the movable contact piece 13.

The second contact part 43 includes a first connecting portion 55, a second connecting portion 56, a first recess 58, and a second recess 59. The first connecting portion 55 and the second connecting portion 56 protrude from the tip of the second contact part 43 toward the movable contact piece 13. The first connecting portion 55 and the second connecting portion 56 are connected to the movable contact piece 13. The first connecting portion 55 and the second connecting portion 56 are respectively disposed outside the first pressing portion 53 and the second pressing portion 54 in the width direction. The first connecting portion 55 and the second connecting portion 56 have a tubular shape.

The first recess 58 is disposed between the first pressing portion 53 and the first connecting portion 55. The second recess 59 is disposed between the second pressing portion 54 and the second connecting portion 56. The first recess 58 is disposed outside the first pressing portion 53 in the width direction. The second recess 59 is disposed outside the second pressing portion 54 in the width direction. The first recess 58 and the second recess 59 have a shape recessed in a direction away from the movable contact piece 13. The first recess 58 and the second recess 59 are disposed apart from the movable contact piece 13.

Figure 10:
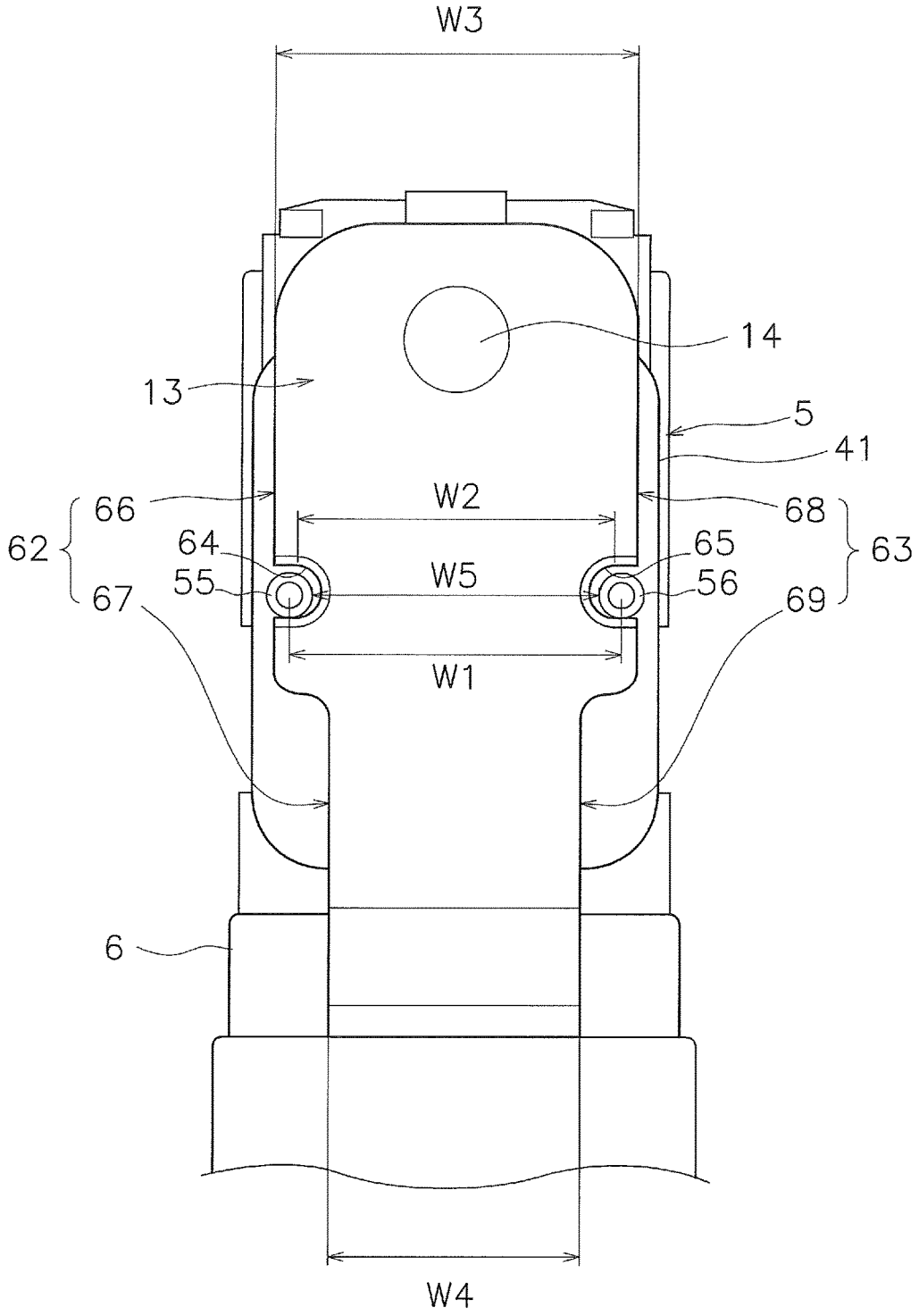
FIG. 10 is a side view of the relay showing a movable contact piece.

FIG. 10 is a side view of the relay showing the movable contact piece 13. As illustrated in FIG. 10, the movable contact piece 13 includes a first side edge 62 and a second side edge 63. The first side edge 62 is one edge of the movable contact piece 13 in the width direction, and the second side edge 63 is the other edge of the movable contact piece 13 in the width direction. The first side edge 62 and the second side edge 63 extend in the up-down direction.

Figure 11:
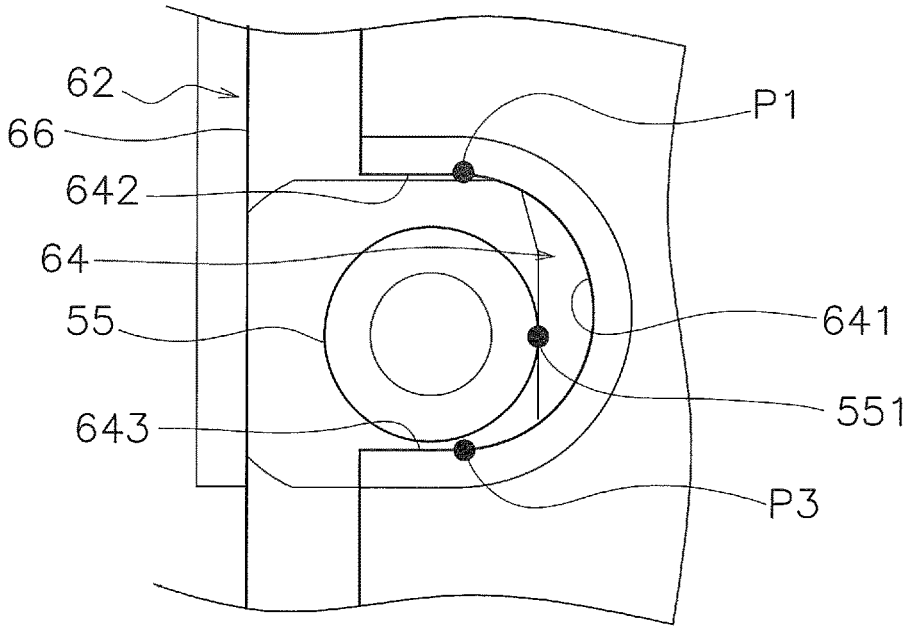
FIG. 11 is an enlarged view of the movable contact piece.
Figure 11:
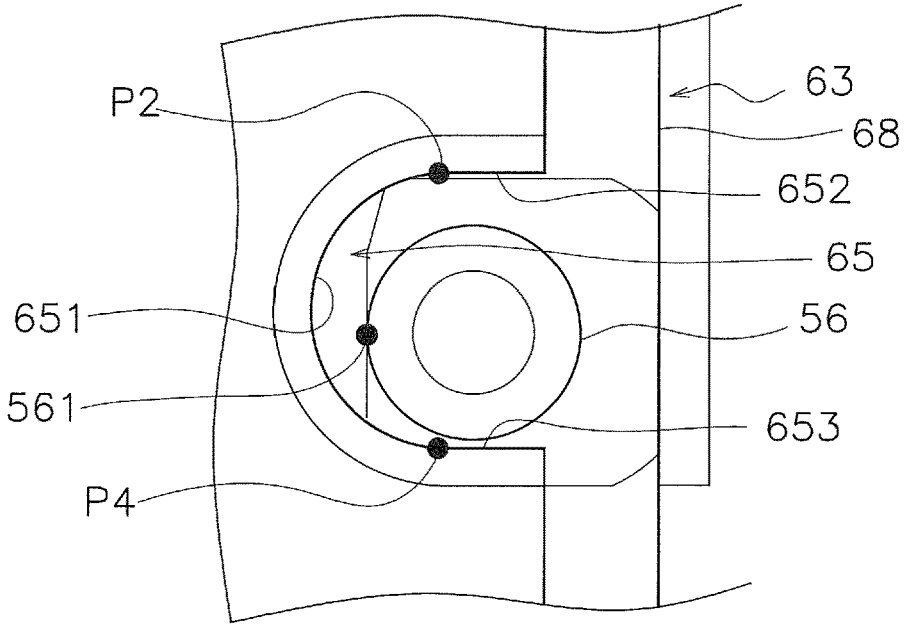

The first side edge 62 includes a first receiving portion 64. The first connecting portion 55 is connected to the first receiving portion 64. The second side edge 63 includes a second receiving portion 65. The second connecting portion 56 is connected to the second receiving portion 65. FIG. 11A is an enlarged view of the first receiving portion 64. As illustrated in FIG. 11A, the first receiving portion 64 has a shape recessed from an edge of the first side edge 62. Burring is applied to the edge of the first receiving portion 64. The first receiving portion 64 includes a curved portion 641, a first straight portion 642, and a second straight portion 643. The first connecting portion 55 is inserted in a space surrounded by the first receiving portion 64.

FIG. 11B is an enlarged view of the second receiving portion 65. As illustrated in FIG. 11B, the second receiving portion 65 has a shape recessed from an edge of the second side edge 63. Burring is applied to the edge of the second receiving portion 65. The second receiving portion 65 includes a curved portion 651, a first straight portion 652 and a second straight portion 653. The second connecting portion 56 is inserted in a space surrounded by the second receiving portion 65.

As illustrated in FIG. 10, the widthwise distance W1 between a center of the first connecting portion 55 and a center of the second connecting portion 56 is larger than the maximum widthwise distance W2 between the curved portion 641 of the first receiving portion 64 and the curved portion 651 of the second receiving portion 65. The maximum distance between the curved portion 641 of the first receiving portion 64 and the curved portion 651 of the second receiving portion 65 is a distance between the connection portion P1 as illustrated in FIG. 11A and the connection portion P2 as illustrated in FIG. 11B, wherein the connection portion P1 connects between the curved portion 641 and the first straight portion 642 of the first receiving portion 64, and the connection portion P2 connects between the curved portion 651 and the first straight portion 652 of the second receiving portion 65. Alternatively, the maximum distance between the curved portion 641 of the first receiving portion 64 and the curved portion 651 of the second receiving portion 65 may be a distance between the connection portion P3 as illustrated in FIG. 11A and the connection portion P4 as illustrated in FIG. 11B, wherein the connection portion P3 connects between the curved portion 641 and the second straight portion 643 of the first receiving portion 64, and the connection portion P4 connects between the curved portion 651 and the second straight portion 653 of the second receiving portion 65.

By setting the widthwise distance W1 between the center of the first connecting portion 55 and the center of the second connecting portion 56 as described above, it becomes difficult for the first connecting portion 55 to contact the curved portion 641 of the first receiving portion 64. Similarly, the second connecting portion 56 is less likely to come into contact with the curved portion 651 of the second receiving portion 65. Therefore, abrasion of the first connecting portion 55 and the second connecting portion 56 is suppressed, and the generation of resin shavings can be suppressed.

As illustrated in FIG. 10, the first side edge 62 includes a first upper side edge 66 and a first lower side edge 67. The second side edge 63 includes a second upper side edge 68 and a second lower side edge 69. The first receiving portion 64 described above is provided at the first upper side edge 66. The second receiving portion 65 is provided at the second upper side edge 68.

The width W3 between the first upper side edge 66 and the second upper side edge 68 is larger than the width W4 between the first lower side edge 67 and the second lower side edge 69. The width W3 between the first upper side edge 66 and the second upper side edge 68 at least in a range from above the first receiving portion 64 and the second receiving portion 65 to below a center of the movable contact 14 is larger than the widthwise minimum distance W5 between the first connecting portion 55 and the second connecting portion 56. The widthwise minimum distance W5 between the first connecting portion 55 and the second connecting portion 56 is a distance between an inner end 551 of the first connecting portion 55 as illustrated in FIG. 11A and an inner end 561 of the second connecting portion 56 as illustrated in FIG. 11B.

The movable contact piece 13 having the above-described shape prevents the movable contact piece 13 from being fitted between the first connecting portion 55 and the second connecting portion 56 when the card 5 is put onto the movable contact piece 13. This prevents the first connecting portion 55 and the second connecting portion 56 from being shaved by the edges of the movable contact piece 13, and thus suppresses the generation of resin shavings.

Figure 12:
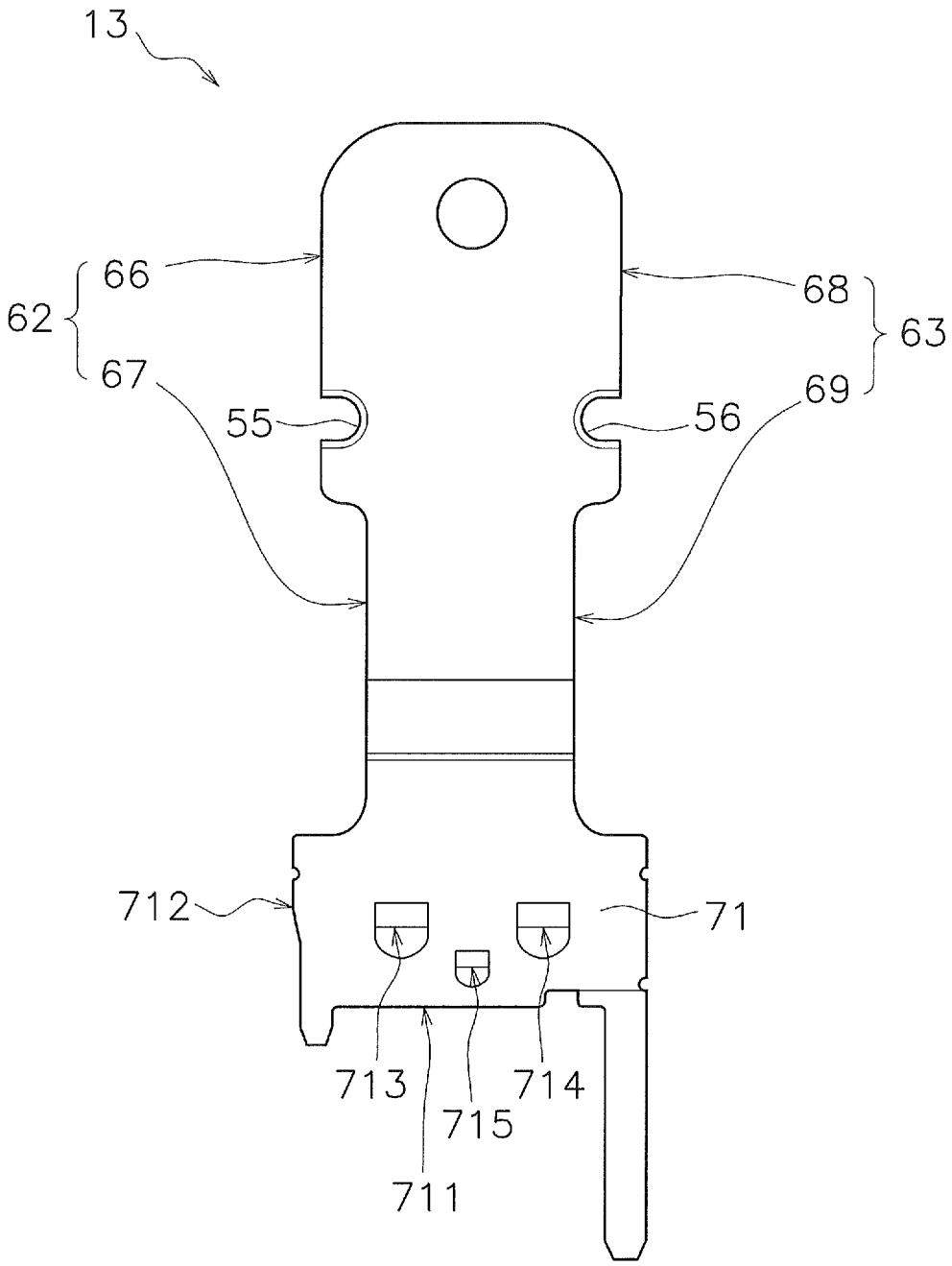
FIG. 12 shows the movable contact piece.
Figure 13:
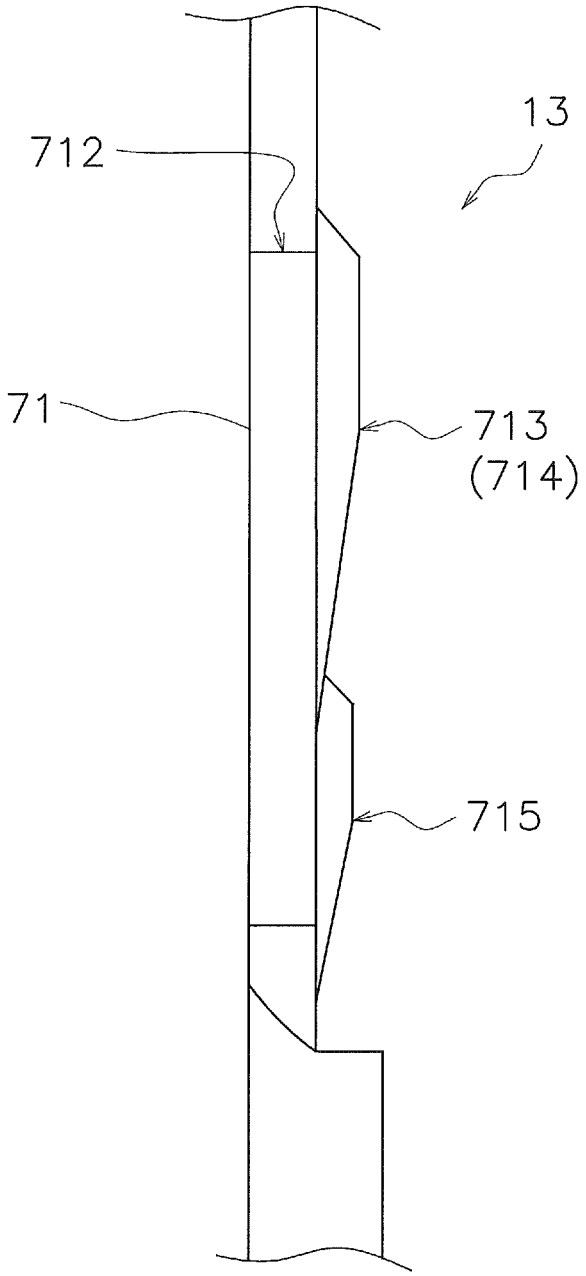
FIG. 13 shows the movable contact piece.

FIGS. 12 and 13 show the movable contact piece 13. As illustrated in FIG. 12, the movable contact piece 13 includes a fixing part 71. The fixing part 71 is inserted into a fixing hole 601 (see FIGS. 1 and 2) of the base 6. The fixing part 71 is pressed into the fixing hole 601 of the base 6 to be attached to the base 6. When assembled, the movable contact piece 13 is pressed into the fixing hole 601 of the base 6 from a lower end 711 side of the fixing part. The fixing part 71 includes a first press-fitting portion 712 and second press-fitting portions 713-715. The second press-fitting portions 713-715 are disposed at locations below the first press-fitting portion 712.

The first press-fitting portion 712 has a larger width than a portion of the fixing part 71 of the movable contact piece 13 below the first press-fitting portion 712. When press-fitted, the first press-fitting portion 712 contacts an inner surface of the fixing hole 601, thereby defining a position for attaching the movable contact piece 13 in the width direction.

As illustrated in FIG. 13, the second press-fitting portions 713-715 have a larger thickness than the other portion of the fixing part 71. When press-fitted, the second press-fitting portions 713-715 contact the inner surface of the fixing hole 601, thereby defining a position for attaching the movable contact piece 13 in the thickness direction. The number of second press-fitting portions 713-715 is not limited to three, and may be less than three or more than three.

Figure 14:
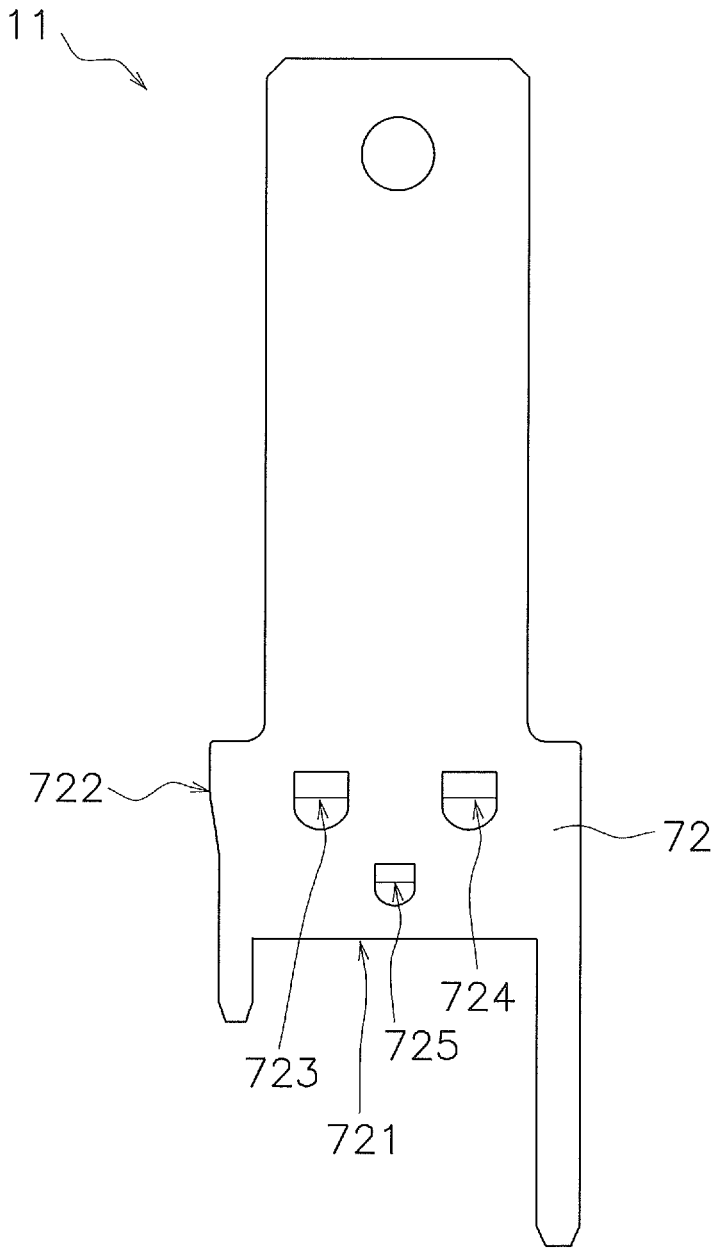
FIG. 14 shows a fixed terminal.
Figure 15:
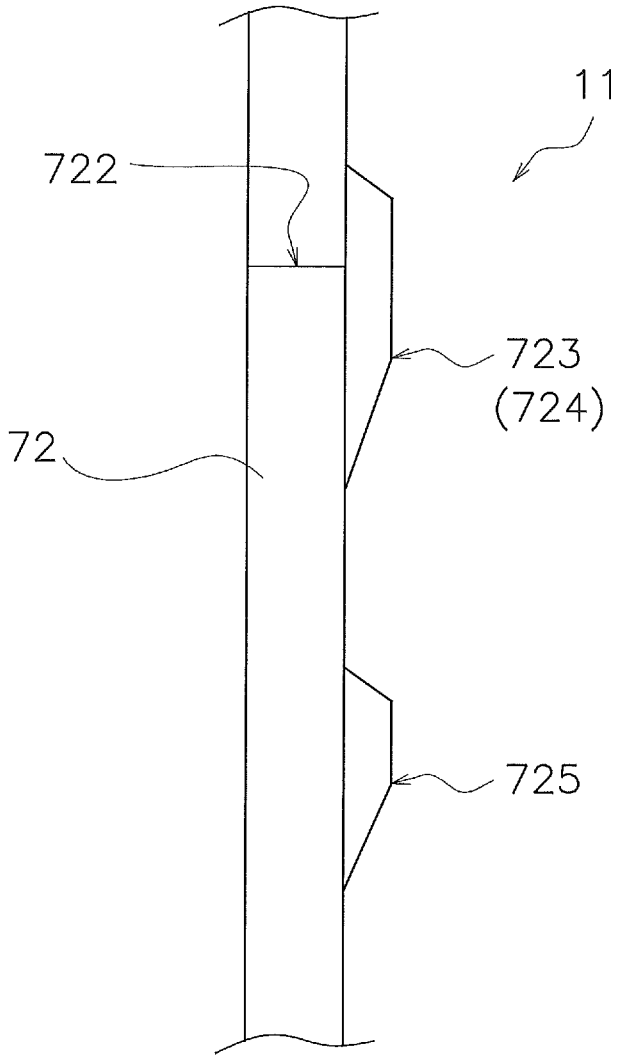
FIG. 15 shows the fixed terminal.

FIGS. 14 and 15 show the fixed terminal 11. As illustrated in FIG. 14, the fixed terminal 11 includes a fixing part 72. The fixing part 72 is inserted into a fixing hole 602 (see FIGS. 1 and 2) of the base 6. The fixing part 72 is pressed into the fixing hole 602 of the base 6 to be attached to the base 6. When assembled, the fixed terminal 11 is pressed into the fixing hole 602 of the base 6 from a lower end 721 side of the fixed terminal 11. The fixing part 72 includes a first press-fitting portion 722 and second press-fitting portions 723-725. The second press-fitting portions 723-725 are disposed at locations below the first press-fitting portion 722.

The first press-fitting portion 722 has a larger width than a portion of the fixing part 72 of the fixed terminal 11 below the first press-fitting portion 722. When press-fitted, the first press-fitting portion 722 contacts an inner surface of the fixing hole 602, thereby defining a position for attaching the fixed terminal 11 in the width direction.

As illustrated in FIG. 15, the second press-fitting portions 723-725 have a larger thickness than the other portion of the fixing part 72. When press-fitted, the second press-fitting portions 723-725 contact the inner surface of the fixing hole 602, thereby defining a position for attaching the fixed terminal 11 in the thickness direction. The number of second press-fitting portions 723-725 is not limited to three, and may be less than three or more than three.

Next, the operation of the relay 1 will be described. When the coil 21 is not energized and the drive unit 4 is demagnetized, the armature 18 is not attracted to the iron core 23.

In this state, as illustrated in FIG. 7, the movable contact 14 is separated from the fixed contact 12 by an elastic force of the movable contact piece 13.

When the coil 21 is energized and the drive unit 4 is excited, the armature 18 is attracted to the iron core 23, and rotates about the upper end of the yoke 24 in an ON direction (counterclockwise in FIG. 7) against the elastic force of the movable contact piece 13. When the armature 18 rotates in the ON direction, the pressing portion 49 of the armature 18 presses the central contact portion 44 of the card 5. Then, the card 5 moves in the ON direction (to the right in FIG. 7), whereby the first pressing portion 53 and the second pressing portion 54 of the card 5 press the surface of the movable contact piece 13 to bring the movable contact 14 closer to the fixed contact 12. As a result, the movable contact 14 is pressed against and comes into contact with the fixed contact 12.

On the contrary, when the coil 21 is de-energized and the drive unit 4 is demagnetized, the first portion 27 of the armature 18 rotates in an OFF direction (clockwise in FIG. 7) to be separated from the iron core 23 by the elastic force of the movable contact piece 13. When the armature 18 rotates in the OFF direction, the pressing portion 49 of the armature 18 moves in a direction away from the central contact portion 44 of the card 5. Then, the card 5 is moved in the OFF direction (to the left in FIG. 7) by the elastic force of the movable contact piece 13, whereby the first pressing portion 53 and the second pressing portion 54 of the card 5 move in a direction to bring the movable contact 14 separate from the fixed contact 12. As a result, the movable contact 14 separates from the fixed contact 12.

With the relay 1 according to the present embodiment as described above, the first pressing portion 53 and the second pressing portion 54 are disposed inside the side edges 62 and 63 of the movable contact piece 13 in the width direction. The resin shavings generated due to contact of the first pressing portion 53 and the second pressing portion 54 with the movable contact piece 13 are likely to pass through the sides of the movable contact piece 13 to reach the contacts 12 and 14 side. The first pressing portion 53 and the second pressing portion 54 are arranged as described above, it is possible to prevent the resin shavings from reaching the contacts 12, 14 side through the sides of the movable contact piece 13. As a result, an occurrence of contact failure due to resin shavings can be suppressed.

In this embodiment, the first pressing portion 53 and the second pressing portion 54 contact a surface of the movable contact piece 13 to press the movable contact piece 13. In this case, the first pressing portion 53 and the second pressing portion 54 come into contact with the surface of the movable contact piece 13, which tends to cause abrasion. This allows the effect of suppressing the occurrence of poor contact due to resin shavings to become more significant.

The card 5 comes into contact with the armature 18 at one point on the central contact portion 44, and comes into contact with the movable contact piece 13 at two points on the first pressing portion 53 and the second pressing portion 54. This can improve the stability in operation. Further, the central contact portion 44 contacts the armature 18 at a location between the first pressing portion 53 and the second pressing portion 54 in the width direction. Therefore, the stability of operation can be further improved.

The card 5 includes a recess 57 disposed between the first pressing portion 53 and the second pressing portion 54. Therefore, the card 5 can be prevented from coming into contact with the movable contact piece 13 at a portion between the first pressing portion 53 and the second pressing portion 54. As a result, it is possible to prevent the card 5 from coming into contact with a central portion of the movable contact piece 13 in the width direction where the temperature becomes high. This can prevent the card 5 from wearing due to heat from the movable contact piece 13.

A tip of the first pressing portion 53 has a shape that is convexly curved toward the movable contact piece 13. A tip of the second pressing portion 54 has a shape that is convexly curved toward the movable contact piece 13. Therefore, the movable contact piece 13 can be stably pressed by the first pressing portion 53 and the second pressing portion 54.

The width W6 of the card body 41 is larger than the width W7 of an outer lateral end of the first pressing portion 53 and an outer lateral end of the second pressing portion 54. Therefore, an insulation distance between the movable contact piece 13 and the drive unit 4 can be increased.

The first connecting portion 55 and the second connecting portion 56 of the card 5 are disposed outside the first pressing portion 53 and the second pressing portion 54 in the width direction. Therefore, wobbling of the card 5 in the width direction with respect to the movable contact piece 13 can be suppressed. Accordingly, the movable contact piece 13 can be stably pressed by the first pressing portion 53 and the second pressing portion 54.

The card 5 includes the first recess 58 and the second recess 59. Therefore, resin shavings generated from the first pressing portion 53 can be released through the first recess 58. Similarly, resin shavings generated from the second pressing portion 54 can be released through the second recess 59. Therefore, it is possible to prevent the resin shavings from reaching the contacts 12, 14 through the sides of the movable contact piece 13. As a result, an occurrence of contact failure due to resin shavings can be suppressed.

Although one embodiment of the present invention has been described above, the present invention is not limited to the above embodiment, and various modifications can be made without departing from the scope of the invention.

A configuration of the contact of the relay 1 is not limited to the above, and may be altered. The configuration of the fixed contact unit 2 may be altered. For example, the shape or arrangement of the fixed terminal 11 may be altered. The shape or arrangement of the first press-fitting portion 722 and the second press-fitting portions 723-725 of the fixed terminal 11 may be altered.

The configuration of the movable contact unit 3 may be altered. For example, the shape or arrangement of the movable contact piece 13 may be altered. The shape or arrangement of the first press-fitting portion 712 and the second press-fitting portions 713-715 of the movable contact piece 13 may be altered. The shape or arrangement of the first receiving portion 64 and the second receiving portion 65 may be altered. The first receiving portion 64 and the second receiving portion 65 may be omitted.

The configuration of the drive unit 4 may be altered. For example, the shape or arrangement of the coil 21 may be altered. The shape or arrangement of the armature 18 or the yoke 24 may be altered.

The shape or arrangement of the card 5 may be altered. For example, the shape or arrangement of the first contact part 42 and the second contact part 43 may be altered. The shape or arrangement of the first connecting portion 55 and the second connecting portion 56 may be altered. The first connecting portion 55 and the second connecting portion 56 may be omitted.

The shape or arrangement of the base 6 may be altered. The shape or arrangement of the case 7 may be altered. For example, the shape or arrangement of the wall 61 may be altered. The wall 61 may be omitted.

According to the present invention, the relay including a card made from resin can suppress an occurrence of contact failure due to resin shavings.

REFERENCE NUMERALS

4: Drive unit
5: Card
11: Fixed terminal
12: Fixed contact
13: Movable contact piece
14: Movable contact
41: Card body
43: Second contact part
44: Central contact portion
53: First pressing portion
54: Second pressing portion
55: First connecting portion
56: Second connecting portion
57: Recess
58: First recess
59: Second recess

The invention claimed is:

1. A relay comprising:
a fixed terminal;
a fixed contact connected to the fixed terminal;
a movable contact piece disposed to face the fixed terminal;
a movable contact connected to the movable contact piece and disposed to face the fixed contact;
a card made from resin, the card configured to press the movable contact piece to operate the movable contact piece; and
a drive unit configured to generate a driving force to operate the card,
wherein the card includes
a first pressing portion configured to contact the movable contact piece and press the movable contact piece,
a second pressing portion disposed apart from the first pressing portion in a width direction of the movable contact piece, the second pressing portion configured to contact the movable contact piece and press the movable contact piece,
a card body disposed between the drive unit and the movable contact piece, and
a contact part extending from the card body toward the movable contact piece, and
the first pressing portion and the second pressing portion are disposed inside side edges of the movable contact piece in the width direction respectively, the first pressing portion and the second pressing portion further disposed at a tip of the contact part, the first pressing portion and the second pressing portion located below the movable contact,
the card body has a larger width than a width between an outer lateral end of the first pressing portion and an outer lateral end of the second pressing portion,
the card further includes
a first connecting portion protruding from the tip of the contact part toward the movable contact piece, the first connecting portion connected to the movable contact piece, and
a second connecting portion protruding from the tip of the contact part toward the movable contact piece, the second connecting portion connected to the movable contact piece, and
the first connecting portion and the second connecting portion are disposed outside the first pressing portion and the second pressing portion in the width direction respectively.

2. The relay according to claim 1, wherein
the drive unit includes
a coil, and
an armature configured to operate the card by electromagnetic force generated from the coil,
the card further includes a central contact portion disposed at a center of the card in the width direction, and
the central contact portion has a shape that is convexly curved toward the armature, the central contact portion configured to be pressed by the armature.

3. The relay according to claim 2, wherein
the central contact portion is configured to contact the armature at a location between the first pressing portion and the second pressing portion in the width direction.

4. The relay according to claim 1, wherein
a tip of the first pressing portion has a shape that is convexly curved toward the movable contact piece, and
a tip of the second pressing portion has a shape that is convexly curved toward the movable contact piece.

5. The relay according to claim 1, wherein
the first pressing portion and the second pressing portion are configured to contact a surface of the movable contact piece to press the movable contact piece.

6. The relay according to claim 1, wherein
the card further includes
a first recess disposed between the first pressing portion and the first connecting portion, and
a second recess disposed between the second pressing portion and the second connecting portion.

7. The relay according to claim 1, wherein
the card further includes a recess disposed between the first pressing portion and the second pressing portion.

8. A relay comprising:
a base;
a fixed terminal;
a fixed contact connected to the fixed terminal;
a movable contact piece extending from the base and disposed to face the fixed terminal;
a movable contact connected to the movable contact piece and disposed to face the fixed contact;
a card made from resin, the card configured to press the movable contact piece to operate the movable contact piece; and
a drive unit configured to generate a driving force to operate the card,
wherein the card includes
a first pressing portion configured to contact the movable contact piece and press the movable contact piece,
a second pressing portion disposed apart from the first pressing portion in a width direction of the movable contact piece, the second pressing portion configured to contact the movable contact piece and press the movable contact piece,
a card body disposed between the drive unit and the movable contact piece, and
a contact part extending from the card body toward the movable contact piece, and
the first pressing portion and the second pressing portion are disposed inside side edges of the movable contact piece in the width direction respectively, the first pressing portion and the second pressing portion further disposed at a tip of the contact part, the first pressing portion and the second pressing portion located between the base and the movable contact in an extending direction of the movable contact piece from the base, the card body has a larger width than a width between an outer lateral end of the first pressing portion and an outer lateral end of the second pressing portion, the card further includes a first connecting portion protruding from the tip of the contact part toward the movable contact piece, the first connecting portion connected to the movable contact piece, and a second connecting portion protruding from the tip of the contact part toward the movable contact piece, the second connecting portion connected to the movable contact piece, and the first connecting portion and the second connecting portion are disposed outside the first pressing portion and the second pressing portion in the width direction respectively.

9. The relay according to claim 8, wherein the drive unit includes a coil, and an armature configured to operate the card by electromagnetic force generated from the coil, the card further includes a central contact portion disposed at a center of the card in the width direction, and the central contact portion has a shape that is convexly curved toward the armature, the central contact portion configured to be pressed by the armature.

10. The relay according to claim 9, wherein the central contact portion is configured to contact the armature at a location between the first pressing portion and the second pressing portion in the width direction.

11. The relay according to claim 8, wherein a tip of the first pressing portion has a shape that is convexly curved toward the movable contact piece, and a tip of the second pressing portion has a shape that is convexly curved toward the movable contact piece.

12. The relay according to claim 8, wherein the first pressing portion and the second pressing portion are configured to contact a surface of the movable contact piece to press the movable contact piece.

13. The relay according to claim 8, wherein the card further includes a first recess disposed between the first pressing portion and the first connecting portion, and a second recess disposed between the second pressing portion and the second connecting portion.

14. The relay according to claim 8, wherein the card further includes a recess disposed between the first pressing portion and the second pressing portion.

* * * * *